United States Patent [19]

Justus

[11] 3,956,832

[45] May 18, 1976

[54] WEB DRYER ARRANGEMENT

[75] Inventor: Edgar J. Justus, Beloit, Wis.

[73] Assignee: Beloit Corporation, Beloit, Wis.

[22] Filed: Sept. 13, 1974

[21] Appl. No.: 505,752

[52] U.S. Cl. ..... 34/115; 34/116

[51] Int. Cl.[2] ..... F26B 11/02

[58] Field of Search ..... 34/114, 115, 159, 116, 34/111, 123

[56] References Cited

UNITED STATES PATENTS

| | | | |
|---|---|---|---|
| 1,573,775 | 2/1926 | O'Brien | 34/116 X |
| 1,830,287 | 11/1931 | Ohlin | 34/18 |
| 2,091,805 | 8/1937 | Chuse | 34/115 |
| 2,197,463 | 4/1940 | Bradner | 34/118 |
| 3,110,575 | 11/1963 | Justin | 34/114 |
| 3,134,653 | 5/1964 | Justin et al. | 34/114 |
| 3,230,636 | 1/1966 | Daane | 34/122 |
| 3,246,401 | 4/1966 | Walser et al. | 34/122 |
| 3,250,019 | 5/1966 | Beachler | 34/117 |
| 3,303,576 | 2/1967 | Sisson | 34/116 X |
| 3,447,247 | 6/1969 | Daane | 34/122 |
| 3,816,941 | 6/1974 | Holik et al. | 34/116 |

*Primary Examiner*—William O'Dea
*Assistant Examiner*—Harold Joyce
*Attorney, Agent, or Firm*—Dirk J. Veneman; Bruce L. Samlan; Gerald A. Mathews

[57] ABSTRACT

A double felted dryer arrangement wherein a web to be dried is held between the felts and guided onto the surface of a foraminous dryer roll whereupon the outermost felt is guided away from the dryer and directed over a hot air blower mounted over the now exposed web carried on the innermost felt on the dryer shell surface. The hot air blowing on the web is complimented by an opposed vacuum chamber within the roll shell to promote improved through air drying web and web stabilization.

4 Claims, 3 Drawing Figures

10
12
14
14a
14b
14c
14d
14e
15
16
16a
16b
16c
16d
16e
16f
16g
16h
16i
16j
16k
16l
16m
16n
16p
16q
16r
16s
16t
16u
18
18a
18b
18c
18d
18e
20
20a
20b
20c
20d
20e
22
22a
22b
22c
22d
22e
24
24a
24b
24c
24d
24e
26
26a
26b
28
28a
28b
30
30a
30b
30c
30d
30e
8

WEB DRYER ARRANGEMENT

BACKGROUND OF THE INVENTION

This invention relates to drying of traveling webs and, more particularly, the drying of a newly formed paper web on a papermaking machine.

Prior dryer arrangements pertaining to double felts, impingement drying (moving hot air against the wet surface) or through air drying (blowing heated air through the web) either guide the bare web onto the dryer shell without support or sandwich it between two felts while carrying it on the dryer roll. Sometimes, a single felt is used in combination with an impingement and/or vacuum arrangement to promote removable of moisture.

All of these arrangements have deficiencies and inefficiencies which become especially troublesome when it is desired to operate at or near the fastest speed the machine is designed for. Such inefficiencies are usually manifested by the web billowing off the dryer roll surface or edge flutter, both of which contribute to web breaks, or simply a decrease in the drying rate as the web passes over the dryers. When speeds increase, the rate of drying must also increase in order to keep the web dryness at the end of the machine within predetermined limits. Double felted air impingement dryers have sometimes required a special, endless belt-like arrangement in addition to the top felt in order to keep the web from fluttering under the force of the impinging air. On configurations wherein both felts track over conventional dryer shell surfaces, web billowing is suppressed, but so is the rate of moisture removal. Furthermore, additional equipment must then be used to remove moisture from the felts in the gaps between dryer rolls. On through air drying arrangements wherein the web is carried on a single felt or belt, the web stability due to edge flutter is impaired as it must travel between dryers without support on one or both sides.

In summary, prior art arrangements have tended to sacrifice drying capacity and efficiency for speed and vice versa.

SUMMARY OF THE INVENTION

This dryer arrangement utilizes the web stabilizing characteristics of a double felt while combining it with hot air drying through the web and one felt for more efficient drying. Since the impinging hot air only travels through the web and one felt, less fan power is required and it is easier to remove the water by either evaporation or physically blowing the water droplets out of the permeable web.

Initially, the web is received and held between two felts and guided onto the surface of a dryer whereupon the uppermost felt is drawn away leaving the exposed web and lowermost felt positioned and supported on the surface of the foraminous dryer roll shell. The upper felt is guided back onto the web and lower felt just prior to the point where they are all removed from the dryer and directed to the next dryer where the procedure is repeated.

A hot air impingement blower is positioned above the periphery of a portion of each dryer roll to direct hot air onto and through the web and single felt while they are on its surface, and a vacuum chamber is positioned within each dryer roll shell opposite the blower to hold the web onto the dryer and promote travel of hot air through the web.

An object of the invention is to provide a web dryer arrangement having positive control of the web throughout the length of the dryer section.

Another object of the invention is to provide a double felted dryer having improved web drying effectiveness.

Still another object of the invention is to provide a double felted web dryer arrangement which utilizes forced hot air and a corresponding air receiving chamber within each dryer unit.

A feature and advantage of the invention is that two identical felts can be used and neither special felt moisture removal equipment nor web hold down belts is required.

DESCRIPTION OF THE PREFERRED EMBODIMENTS

The preferred embodiment is described in conjunction with a paper web as produced on a papermaking machine and the dryers are rotatable rolls positioned in the staggered array commonly used in the paper industry. However, it is anticipated that other kinds of webs, such as textiles, could also be dried well with this apparatus. Also, it is contemplated that arcuate, non-rotatable, foraminous support surfaces could be used instead of rotatable rolls. In that case the felts would slide over the support surfaces.

Figure 1:
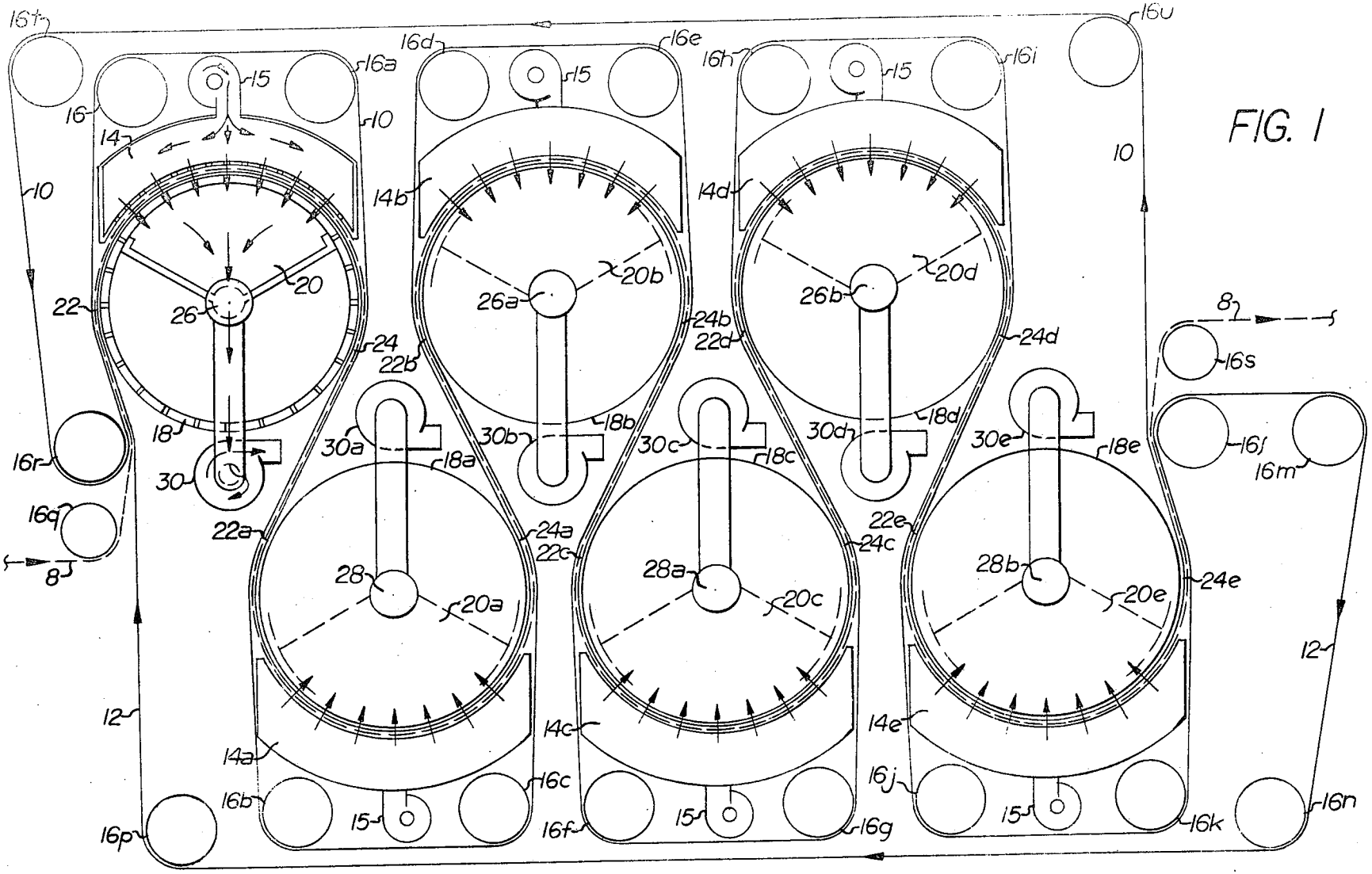
FIG. 1 is a somewhat schematic side elevational view of a papermachine dryer section illustrating the path of travel of the felts and web.

As shown in FIG. 1, a paper web 8 is received between a first, upper felt 10 and a second, lower felt 12 which are traveling in the direction indicated by the arrowheads. A plurality of guide rollers **16–16*u* are mounted on framework (not shown) above and below the dryers 18–18*e*** to move the felts and web into position onto and about the dryers.

In the drawings, lettered postscripts are used to designate multiple items of identical equipment or corresponding positions on separate items.

The web is held between the felts until they contact the surface of dryer roll 18 at point 22 where, or shortly thereafter, the outermost (upper) first felt 10 is guided away from the surface of dryer roll 18, about rollers 16, **16*a* and back onto the web at point 24 whereupon, or shortly thereafter, the two felts with the web in between are guided off dryer 18 and onto dryer 18*a* at point 22*a*. The web travel continues in the same manner along a serpentine path sequentially from dryer 18 to dryer 18*e*** and the outermost felt is guided away from the web, over the guide rollers, and back onto the web before traveling to the next dryer.

Dryers **18–18*e* are shown arranged in upper and lower tiers with their corresponding upper and lower axes 26–26*b*, 28–28*b***, respectively, parallel and coplaner as is commonly done in the paper industry. However, the dryer rolls could be positioned in other arrangements with the axes of the dryers in the upper and lower tiers not necessarily coplaner.

Figure 3:
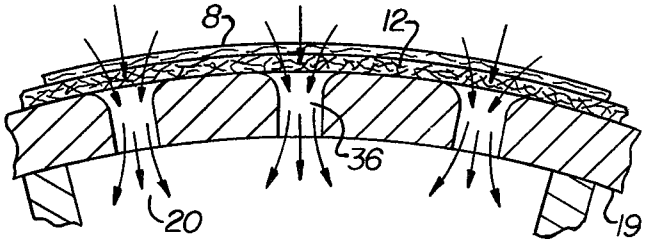
FIG. 3 is a sectional view of a dryer roll shell showing the web and felt positioned thereon and the perforations through which air is received into the vacuum chamber within the dryer roll.

The dryer rolls are rotatably mounted in the frame (not shown) and have an outer shell made foraminous, such as by perforating it with evenly spaced drilled holes or constructing it of an open, grid-like honeycomb fabrication. A cross section of a portion of a dryer roll outer shell 19 is shown in FIG. 3 which illustrates air flowing against the web 8, through felt 12 and holes 36 in the shell 19. Within each dryer roll shell, a chamber 20–20*e* is positioned to be between the points 22–22*e*, 24–24*e* where the double felts contact and leave the roll shell surface, respectively. A vacuum pump 30–30*e* is operatively connected to each chamber 20–20*e*, respectively, to receive and remove air and water vapor from the web and contiguous felt as well as to urge and maintain them against the roll shell surface.

Figure 2:
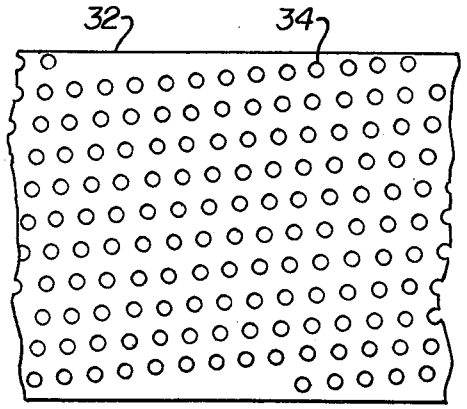
FIG. 2 is a plan view of the bottom wall of the hot air blower plenum chamber showing the holes which serve as the air impingement nozzles.

Mounted about the periphery of each roll over that portion covered by the web and innermost felt (relative to the dryer shelf surface) is a hot air blower 15–15*e*. A plenum chamber 14–14*e* therein has a wall 32–32*e*, having openings, such as perferations 34–34*e*, which arcuately conforms to the roll shell surface as shown in FIGS. 2 and 3, to direct hot air against the web covered dryer roll surface.

In operation, when the felts having the web held therebetween arrive at point 22 on roll 18, the first felt 10, being the outermost felt on roll 18, is guided up and over hot air blower 15. This permits hot air to be blown directly onto the now exposed web 8. The vacuum chamber 20, which extends arcuately beneath the shell substantially from point 22 to point 24, urges the web onto the second felt 12 and roll surface to discourage billowing of the web off the surface. Such web billowing, if not eliminated, would either result in a web break or require reduced speed to prevent a web break, both of which are uneconomical and highly undesirable.

The removal of the outermost felt from the web opposite the vacuum chamber reduces the layers of material which the blower must push hot air through. This and the fact that the web surface is exposed to the hot air greatly increases the efficiency and effectiveness of the drying operation.

When the first felt again rejoins the web 8 and second felt 12 at point 24, the web is now positively supported by a felt on either side in the gap between successive dryers. When the felts and web bear on any of the lower tier dryers (having axes 28–28*b*), the first felt 10 becomes the innermost felt and the second felt 12 becomes the outermost felt. These "inner" and "outer" felt designations, with respect to the first and second felts, are reversed when referring to the upper tier dryers (axes 26–26*b*).

Thus, as the web travels from upper to lower dryers 18, 18*a*, 18*b*, 18*c*, 18*d*, 18*e*, the first and second felts alternate being adjacent the roll shell surface and being guided away from the roll and around the hot air blowers. Thus, both felts 10, 12, are utilized equally and are of identical construction, although they need not be. Furthermore, it is contemplated that both felts could be the open weave, fabric type to facilitate movement of air and water therethrough. Such fabrics are now sometimes made of plastic or fiberglass.

As the endless felts 10, 12 and web emerge from the late dryer contact point 24*e*, the felts are guided around rollers 16*u*, 16*l* 16*m*, back to the first dryer and the now dry web is guided away in the direction shown by the arrow.

At all times during the travel through the dryer section, web billowing over the dryer surface and edge flutter in the span along the path of travel between successive dryers is controlled and stabilized by either vacuum pressure or by virtue of being supported on both sides in the open span between dryer rolls. In addition, by temporarily removing the outer felt during the time the web is beneath the hot air blower, the insulating effect of the felts to heat transfer is greatly reduced, thus allowing greater drying effectiveness and efficiency. Also, each side of the web is alternately exposed to the hot, drying air. Less power is required to blow hot air, water vapor and particles out of the web, into and through the lower felt. This water vapor is then driven through the foraminous roll shell and into the vacuum chamber, which assists in removing it from the web and lower felt, where it is removed by the vacuum pump. Such a configuration results in an increase in drying effectiveness of 40–60% over an arrangement wherein both felts remain in contact with the web throughout its travel through the dryer section 18–18*e*.

What is claimed is:

1. Apparatus for drying a traveling, permeable web comprising:

at least a pair of support members, each having a foraminous surface and arranged in an upper and a lower tier;

a pair of felt members for supporting the web on either side thereof;

guide means for a. directing the felts and interposed web onto the surface of a support member whereby one felt member is innermost relative to the support member surface and the other felt member is outermost relative thereto, b. guiding the outermost felt member away from the web in spaced relationship thereto while the now exposed web and innermost felt remain on the support member surface, c. returning the outermost felt member to contact the seb so that the web is in supporting contact with both felts, d. removing the felts and interposed web from the support member surface and conveying them onto the surface of a support member in the other tier, e. guiding the outermost felt member, which was the innermost felt member relative to the immediately preceding support member surface, away from the web in spaced relationship thereto while the now exposed web and innermost felt member, which was the outermost felt member relative to the immediately preceding support member surface, remain on the support member surface, f. removing the felts and interposed web from the support member surface in said other tier;

a hot air supply means positioned about the support members' surface in spaced, substantially parallel adjacency to the exposed web on the innermost felt and between the web and outermost felt member to direct hot air onto and through the web and innermost felt member to provide equal exposure of the felts and of both sides of the web thereon to the drying effects of the hot air blowers as they are conveyed from tier to tier;

vacuum chamber means mounted beneath the foraminous support members' surface to draw hot air and water vapor through the web and lowermost felt member and maintain the web in stabilized condition while exposed on the lowermost felt above the vacuum chamber means.

2. Apparatus as set forth in claim 1, wherein:

there are a plurality of support members, each comprising a rotatable roll having a foraminous, cylindrical shell.

3. Apparatus as set forth in claim 1, wherein:

the hot air blower means and vacuum chamber means are substantially coextensive on either side of the foraminous roll shell.

4. Apparatus as set forth in claim 1, wherein:

the hot air supply means includes a plenum chamber having a perforated wall forming nozzles to direct hot air onto the web.

* * * * *